US008193431B1

(12) United States Patent
Engler

(10) Patent No.: US 8,193,431 B1
(45) Date of Patent: Jun. 5, 2012

(54) GUITAR HAMMER AND METHOD

(76) Inventor: Mark Engler, Media, PA (US)

( * ) Notice: Subject to any disclaimer, the term of this patent is extended or adjusted under 35 U.S.C. 154(b) by 72 days.

(21) Appl. No.: 12/953,891

(22) Filed: Nov. 24, 2010

(51) Int. Cl.
*G10D 3/16* (2006.01)

(52) U.S. Cl. ..... 84/322; 84/454

(58) Field of Classification Search ..... 84/453, 84/315–323

See application file for complete search history.

(56) References Cited

U.S. PATENT DOCUMENTS

| | | | | |
|---|---|---|---|---|
| 398,176 | A | 2/1889 | Oerlin | |
| 461,915 | A | 10/1891 | Mackenzie | |
| 490,407 | A | 1/1893 | Eisenbrandt | |
| 1,160,392 | A | 11/1915 | Domaschewicz | |
| 1,226,352 | A | 5/1917 | Menzenhauer | |
| 1,352,618 | A | 9/1920 | Nickerson | |
| 1,593,809 | A | 7/1926 | Vana | |
| 1,606,522 | A | 11/1926 | Freedlander | |
| 1,653,241 | A | 12/1927 | Vana | |
| 1,892,416 | A | 12/1932 | Vitto | |
| 3,217,581 | A | 11/1965 | Hinger | |
| 3,460,424 | A | 8/1969 | Tepper | |
| 4,386,549 | A | 6/1983 | Shinneman | |
| 4,592,263 | A | 6/1986 | Galliore | |
| 4,640,177 | A | 2/1987 | Elliott | |
| 4,649,792 | A | 3/1987 | Swartzlander | |
| 4,936,181 | A | 6/1990 | Marron | |
| 5,320,019 | A * | 6/1994 | McCaw | 84/323 |
| 2,528,663 | A | 11/1995 | Mitchell | |
| 6,369,304 | B1 | 4/2002 | Tucker | |
| 6,483,016 | B1 | 11/2002 | Thum | |
| 7,622,662 | B2 | 11/2009 | Shaper | |
| 2009/0235805 | A1 | 9/2009 | Hamilton | |

* cited by examiner

*Primary Examiner* — Kimberly Lockett
(74) *Attorney, Agent, or Firm* — Robert J. Yarbrough; Lipton, Weinberger & Husick

(57) ABSTRACT

A hand-held hammer for playing a guitar includes a handle, an arm and a head. The head has a head longitudinal axis and a striking surface that is generally transverse to the longitudinal axis of the arm. The striking surface is curved and equal to or longer than the distance between the first and fourth string of a six-string guitar. The player holds the guitar, selects the string length by fretting one or more strings, grips the hammer by the handle and strikes the strings with the striking surface.

20 Claims, 10 Drawing Sheets

GUITAR HAMMER AND METHOD

I. BACKGROUND OF THE INVENTION

A. Field of the Invention

The invention is a hammer for use in playing a guitar, the combination of the guitar and the hammer, and a method of using the apparatus of the invention.

B. Description of the Related Art

Hand-held hammers or mallets are used to strike percussion instruments to generate a sound. Common examples include drums, marimbas and xylophones. Hammers may be used to strike a string under tension to cause the string to vibrate and to generate sound from the vibrating string. Common examples include pianos and members of the hammered dulcimer family. The piano utilizes a mechanical action to propel a hammer into the strings when a key is depressed. The hammered dulcimer has no mechanical action and playing a hammered dulcimer involves striking one or more strings with hand-held hammers. Both the piano and hammered dulcimer have strings of fixed pitch and the number of strings determining the range of the instrument.

The acoustic guitar is a plucked-string instrument of the lute family, with a resonating body and strings running along a neck. In the conventional playing of a guitar, the player utilizes either a pick or the player's fingers to pluck a string, causing the string to vibrate and generating a sound. The vibrating length of each string, and hence the pitch of the sound generated by the string, is varied by "fretting" the string; namely, by depressing the string against the neck of the guitar using the player's fingers.

During play, the body of the guitar is held against the torso of the player. For a right-handed player utilizing a pick, the pick is gripped between the thumb and index finger of the player's right hand, with the wide dimension of the pick oriented generally parallel to the strings. The player's left hand grips the neck of the guitar and appropriately depresses a string, determining the pitch of the sound produced by the plucked string.

An electric guitar is similar to an acoustic guitar but includes an electromagnetic or piezoelectric pickup to generate an electrical signal from the vibrating string, an amplifier to increase the amplitude of the resulting signal and a loudspeaker to convert the amplified electrical signal to sound. The electric guitar may dispense with the resonating body of the acoustic guitar.

The prior does not teach the present Invention.

II. BRIEF DESCRIPTION OF THE INVENTION

The Invention is a hand-held hammer for striking the strings of a guitar, either electrical or acoustic, to excite the strings and to generate a sound. The Invention is also a combination of a guitar and the hammer and is a method of playing a guitar using the apparatus of the invention.

The guitar played using the hammer of the invention is a conventional acoustic or electric guitar. The hammer of the invention includes an elongated arm having a first end and a second end, a head and a handle. The handle is attached to the first end of the arm and the head is attached to the second end of the arm.

The handle is configured with opposing sides. The opposing sides of the handle provide gripping surfaces and allow the player to grip the handle between the thumb and index finger of the player, similar to the grip used by the player holding a conventional flat pick. The opposing sides may be flat and parallel, like a flat pick, or may be curved to accommodate the contour of the thumb and index finger of the player. When the opposing sides of the handle are curved, the curve of the gripping area of the opposing sides may define simple, rather than compound, curves. The simple curves may be selected such that a line falling on the gripping surface of either opposing side is generally parallel to the line falling on the other gripping surface and on a plane normal to the longitudinal axis of the elongated arm.

The handle may be adjustably attached to the first end of the arm. The adjustable attachment of the handle to the arm allows the arm to be extended from the handle, thereby adjusting the overall length of the hammer. The adjustable attachment of the handle to the arm also allows the angular position of the handle with respect to the arm and the head to be selected by the player. The adjustable attachment may comprise the arm being circular in cross section and penetrating a corresponding opening in the handle. A set screw is in threaded engagement with a threaded hole in the handle. When the arm and handle are in engagement and the set screw is tightened, the set screw interferes with the arm, holding the arm in position within the handle. Any other means for adjustably attaching the arm and the handle are contemplated by the invention, including a cam clamp securing the arm within the handle, a threaded engagement between the arm and handle, an interference fit between the opening in the handle and the arm, a bayonet connection between the arm and handle, and a releasable adhesive connection between the arm and handle.

The arm may be something other than circular in cross section, such as the arm defining a flat side, the arm defining an external thread or the arm having a plurality of sides. If the arm defines an external thread, the adjustment of the length of the hammer and the adjustment of the angular location of the head with respect to the arm and the head may be accomplished by placing the handle in threaded engagement with the arm and rotating the head with respect to the arm. Fixing the arm and handle in the selected location may be accomplished by a jam nut also in threaded engagement with the arm.

If the arm has a plurality of sides, the arm may have a cross section exhibiting two, three, four, five or more sides. When the arm has a plurality of sides, the player may select from among a plurality of rotational orientations of the handle with respect to the arm. Use of an arm having a plurality of sides may assist in the handle maintaining its angular position with respect to the arm. If the arm has a plurality of sides, the opening in the handle may have a cross section corresponding to the cross section of the arm and having a plurality of sides so that the arm matably engages the opening in the handle and the corresponding plurality of sides prevent rotation of the arm with respect to the handle.

The handle may be in a fixed position with respect to the arm and the arm may be of fixed length with respect to the handle, as by an adhesive joining the handle and arm or where the arm and handle are unitary. When the handle and arm are in a fixed relative position, the angular orientation of the handle preferably is oblique to the head, so that the longitudinal axis of the head is generally parallel to the plane defined by the strings of the guitar when the player holds the guitar in the conventional playing position, with the body of the guitar against the torso of the player, with the handle gripped between the thumb and index finger of the player's right hand and with the player's right hand located above the top of the guitar and generally between the guitar bridge and the sound hole.

The head of the hammer is attached to the second end of the arm. The head has a head longitudinal axis and defines a curved striking surface. The head longitudinal axis is generally transverse to the longitudinal axis of the arm. The head longitudinal axis defines an angle to the longitudinal axis of the arm and the angle may be selectable by the player. To allow the angle between the head and the arm to be selected, the head and arm may be equipped with an adjustment mechanism. The adjustment mechanism may comprise a clamping screw passing through a clearance hole defined by the arm and in threaded engagement with the head. Loosening the clamping screw allows the angle between the arm and the head longitudinal axis to be selected. Tightening the clamping screw locks the arm and head in position. In one embodiment, the angle of the head longitudinal axis may be selected to be between 72.5 degrees and −72.5 degrees inclusive with respect to a line normal to the longitudinal axis of the arm.

Other adjustment mechanisms also may be used. For example, the head may be equipped with a plurality of holes on either side of the striking surface. Each hole defines a different orientation of the striking surface with respect to the arm and is configured to define an interference fit with the second end of the arm, as by a matching taper of both the walls of the hole and the arm. The player selects the desired orientation of the head with respect to the arm by selecting the appropriate hole and inserting the arm into the selected hole. The player also selects the rotational orientation of the arm (and hence the handle) with respect to the head and inserts the tapered end of the arm into the tapered opening of the selected hole. The interference fit between the arm and the hole maintains the hammer head in the desired rotational location and angular location with respect to the arm and hence with respect to the handle.

The length of the head longitudinal axis is approximately equal to the distance between the first and last strings of the guitar, but a shorter length may be selected. For a six-string guitar, the length of the head longitudinal axis is approximately the distance between the first and sixth strings of the guitar, but should be greater than or equal to the distance between the first and fourth strings of the guitar.

The striking surface of the hammer is preferably is in the shape of a shallow curve. The shallow curve of the head allows the player to strike two or more strings simultaneously without having the striking surface perfectly aligned with the plane defined by the guitar strings. Alternatively, the striking surface of the head may be flat along the head longitudinal axis or may be generally flat with an upward curve at either end of the head longitudinal axis. Such a construction allows the player to strike more than one string simultaneously, but requires a high degree of accuracy in orienting the hammer head by the player.

The curve of the striking surface may define a portion of an ellipse, such as half of an ellipse, where the half ellipse falls on one side of a line running through the two foci of the ellipse. The ellipse preferably has a high eccentricity, preferably greater than 0.7, resulting in a relatively broad, relatively flat elliptical curve. The elliptical shape of the striking surface reduces the torsion applied to the head when the head strikes the strings at other than an optimal orientation compared to a flat hammer head, and hence reduces the tendency of the handle to turn in the grip of the player. The high eccentricity of the ellipse and the resulting broad, flat shape of the curve allow the player to strike more than one string of the guitar at one time.

The broad, shallow curve of the hammer head also allows the player to select which strings of the guitar to strike by rotating the player's wrist about the longitudinal axis of the player's arm without moving the player's wrist or fingers in a direction parallel to the plane defined by the strings of the guitar. The broad, shallow curve of the hammer head also allows the player to strike selected strings by rotating the player's wrist about the longitudinal axis of the player's arm to strike the strings with the regions of the striking surface near the ends of the head longitudinal axis of the hammer head.

Different players have different postures when playing the guitar. Different angles between the head longitudinal axis of the hammer head and the longitudinal axis of the arm can accommodate those different postures while maintaining the head longitudinal axis of the striking surface in an orientation that is generally normal to the long dimension of the guitar strings.

In use, the player holds the guitar in the usual playing position, with the body of the guitar against the torso of the player. The player grips the neck with the player's left hand and cradles the rear bout of the guitar with the player's right arm and elbow. The player's hand is located above the guitar strings and generally between the guitar neck and the guitar bridge. The player grips the hammer handle between the player's thumb and forefinger, just as the player would grip a conventional flat pick. The handle is oriented with respect to the arm so that the arm extends from the handle generally toward the neck. For a conventional acoustic guitar with a circular sound hole between the upper and lower bouts, the arm of the hammer extends toward the circular sound hole. The player holds the handle so that the head longitudinal axis of the hammer head is generally parallel to a plane defined by the guitar strings.

The player selects the pitch of one or more strings by fretting the strings with the player's left hand. The player then strikes one or more strings by moving the player's right hand in a direction normal to the plane defined by the strings of the guitar. Alternatively, the play can strike one or more strings by rotating the player's wrist about the longitudinal axis of the player's right arm, causing the region of the striking surface toward the ends of the head longitudinal axis of the hammer head to strike the strings.

The handle may be equipped with a plectrum mounted to the handle, the plectrum having two opposing sides and being generally thin and flat, whereby the player may grip the handle of the hammer and pluck one or more strings of the guitar with the plectrum.

The above description applies to a player playing a right-handed guitar. For a player playing a left-handed guitar the description is the same, except that the designations of 'right' and 'left' are reversed.

As noted above, the invention is also a combination of a conventional acoustic or electric guitar and the hammer of the invention.

III. BRIEF DESCRIPTION OF THE DRAWINGS

IV. DESCRIPTION OF AN EMBODIMENT

The invention is a hammer 2 for playing a guitar. The guitar may be any conventional guitar, including an electric, acoustic, bass or twelve-string guitar. An electric guitar may have a hollow body or a solid body. The hammer may be used to play any instrument of the lute family; that is, instruments having a body, a neck and strings stretched between the body and the neck.

Figure 1:
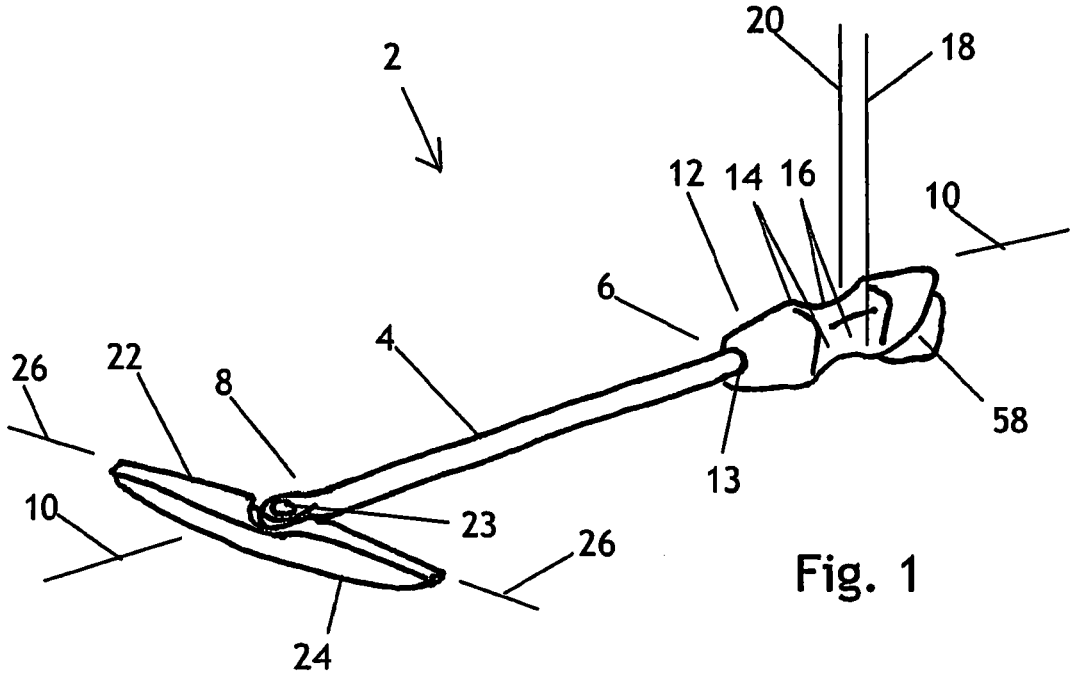
FIG. 1 is a perspective view of the hammer of the invention.
Figure 2:
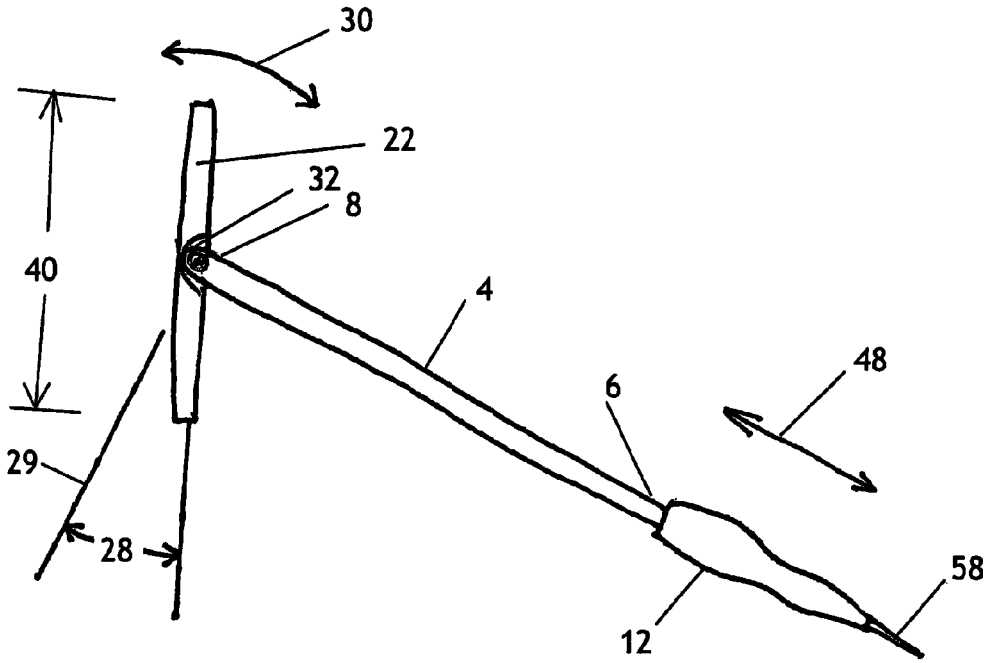
FIG. 2 is a plan view of the hammer of the invention.

As illustrated by FIGS. 1 and 2, the hammer 2 of the invention includes an arm 4. Arm 4 has a first end 6 and a second end 8. Arm 4 is elongated and defines a longitudinal axis 10.

Handle 12 has a handle attachment 13 to the first end 6 of arm 4. Handle attachment 13 may be releasable and may comprise an adjusting mechanism 56. Handle 12 has two opposing sides 14 that define a pair of gripping surfaces 16. The gripping surfaces 16 may be flat, like the opposing surfaces of a conventional flat pick, or may be curved as illustrated in FIGS. 1 and 2. If the gripping surfaces 16 are curved, the curves of each may be a simple curve and a straight line 18 falling on one curved gripping surface 16 and also falling on a plane normal to longitudinal axis 10 of arm 4 is parallel to the straight line 20 falling on the other gripping surface 16 and falling on the same plane normal to longitudinal axis 10 of arm 4.

Figure 5:
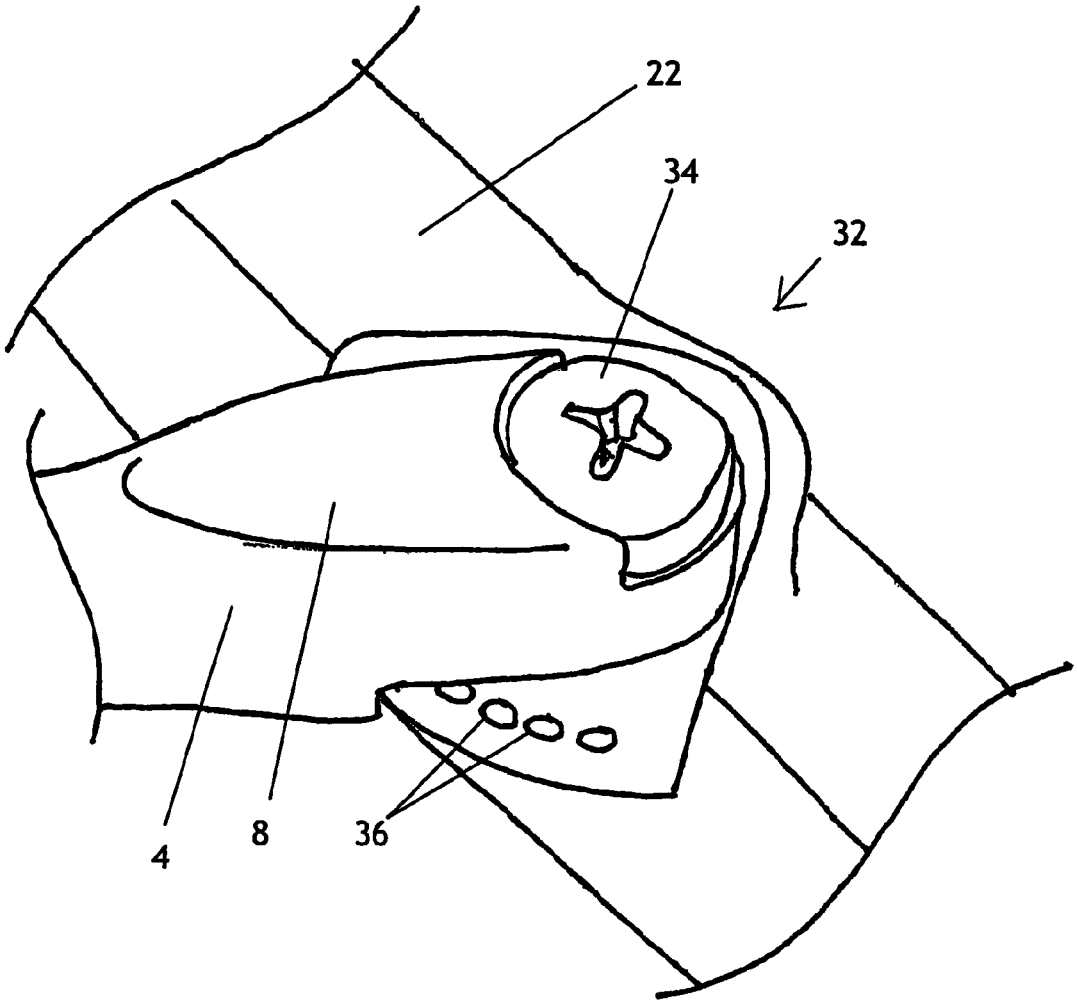
FIG. 5 is a detail perspective view of the attachment of the head to the arm.

From FIGS. 1, 2 and 5, the hammer 2 includes a head 22 having a head attachment 23 to the second end 8 of arm 4. The head 22 features a striking surface 24. The head 22 is elongated and has a head longitudinal axis 26. The striking surface 24 extends from one end of the elongated head 22 to the other along the head longitudinal axis 26. The striking surface 24 is generally transverse to the longitudinal axis 10 of arm 4. From FIG. 2, the head longitudinal axis 26 defines an angle 28 with respect to a line normal to the arm longitudinal axis 10.

The angle 28 may be fixed, as when the head 22 and arm 4 are unitary. The fixed angle 28 generally is oblique to the arm longitudinal axis 10. The fixed angle 28 may be selected so that the head longitudinal axis 26 is generally normal to the guitar strings in the vicinity of the guitar sound hole when a player holds the handle 12 by gripping the gripping surfaces 16 between the player's thumb and index finger of the players right hand, holding the guitar in the conventional playing position with the body of the guitar against the player's torso while gripping the neck of the guitar with the player's left hand and holding the player's right thumb and index finger generally above the guitar top between the upper edge of the guitar lower bout and the strings and between the guitar sound hole and the guitar bridge. For a player of a left-handed guitar, the above description applies except that 'left' is exchanged for 'right' wherever it appears.

The angle 28 may be selectable by the player. If the angle 28 is selectable, the angle may be adjusted in the direction indicated by arrow 30 shown on FIG. 2. One way to allow adjustment of the angle 28 is illustrated by FIGS. 1, 2 and 5. FIG. 5 is a detail of an adjustable attachment of head 22 to second end 8 of arm 4. A lockable pivot 32 is defined by a through hole in the second end 8 of arm 4 receiving a clamp screw 34. The clamp screw 34 is in a threaded engagement with the head 22. In the lockable pivot illustrated by FIG. 5, the second end 8 of the arm 4 has pegs that selectably engage with peg-receiving openings 36 in the head 22. To adjust the angle 28, the player loosens clamping screw 34, selects the desired angle 28 so that the pegs engage the peg-receiving openings 36 and re-tightens the clamping screw 34. The clamping effect of the clamping screw 34 and the engagement of the pegs and peg-receiving openings 36 prevent the head 22 from moving with respect to the arm 4.

Angle 28 preferably is selectable between plus or minus 72.5 degrees inclusive from a line 29 passing through the lockable pivot 32 and normal to the arm longitudinal axis 10. Any other angle 28 that a player may desire is contemplated by the invention.

Figure 6:
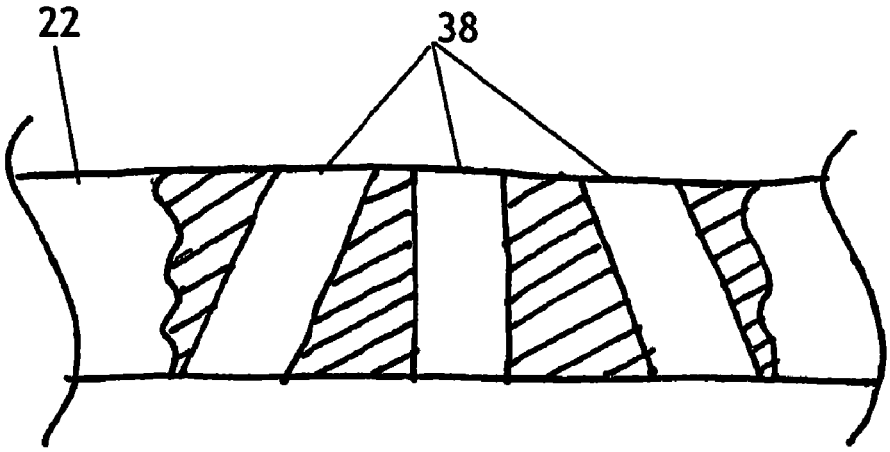
FIG. 6 is a detail cutaway of an alternative embodiment of a head attachment.
Figure 7:
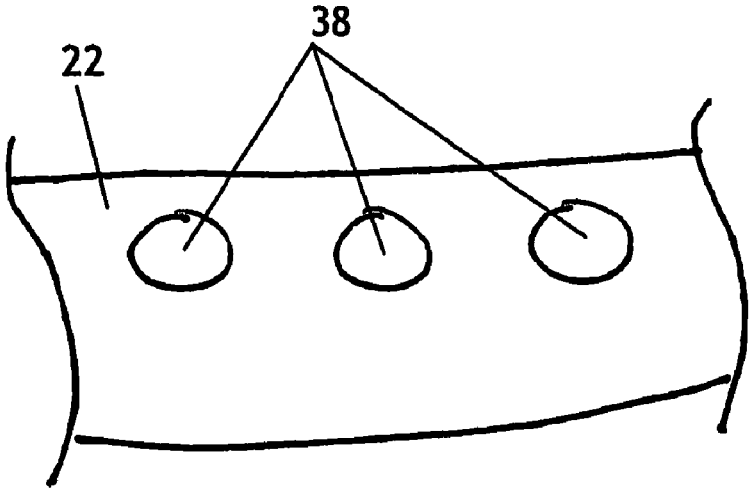
FIG. 7 is a detail of the alternative embodiment of FIG. 6.

Other means to allow selection among a plurality of angles 28 also are contemplated by the invention. For example, as shown by FIGS. 6 and 7, a plurality of holes 38 may be defined by head 22. Each of the holes 38 is configured to receive and retain second end 8 of arm 4, as by second end 8 and holes 38 having a matching slight taper. FIG. 6 is a detail cutaway showing holes 38 in head 22, each defining a different angle 28 when the arm 4 engages the hole 38. FIG. 7 is a detail side view of the head 22 and openings to the holes 38. Other means to fix the arm 4 in engagement with the head 22 are contemplated, such as a cam clamp 50 of the type illustrated by FIG. 8 relating to the handle 12 or a releasable adhesive joining the head 22 and arm 4.

The elongated head 22, and hence the striking surface 24, has a length 40 along the head longitudinal axis 26, as illustrated by FIG. 2. The length 40 is selected to correspond to the distance between the first string and the sixth string of a six-string guitar along a line normal to the first and sixth strings. The elongated length 40 allows the striking surface 24 to engage a plurality of strings simultaneously. The length 40 may be selected to be greater or less than the distance from the first to the sixth strings, as desired by the player, but should be equal to or greater than the distance between the first and fourth strings of a six-string guitar.

Figure 4:
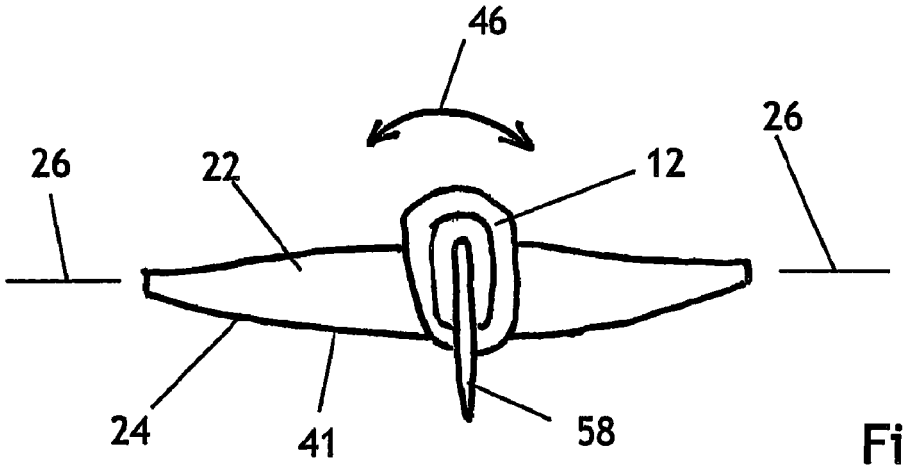
FIG. 4 is an end view of the hammer of the invention.

The striking surface 24 extends the length 40 of the head 22. As shown by FIG. 4, the striking surface generally is a flattened curve 41. The use of a curve 41 allows the head 22 to strike a plurality of the guitar strings simultaneously without the head longitudinal axis 22 being perfectly parallel to the plane of the guitar strings. The curve 41 may define a portion of an ellipse on one side of the line running through both foci of the ellipse. Where the curve 41 is in the shape of a portion of an ellipse, the ellipse preferably has an eccentricity of 0.7 or greater, where the eccentricity is defined as the ratio of the distance between the two foci of the ellipse divided by the major axis of the ellipse. An eccentricity of 0.7 or greater results in the ellipse being flattened. The curve 41 of the striking surface 24 may define any portion of an ellipse.

Figure 3:
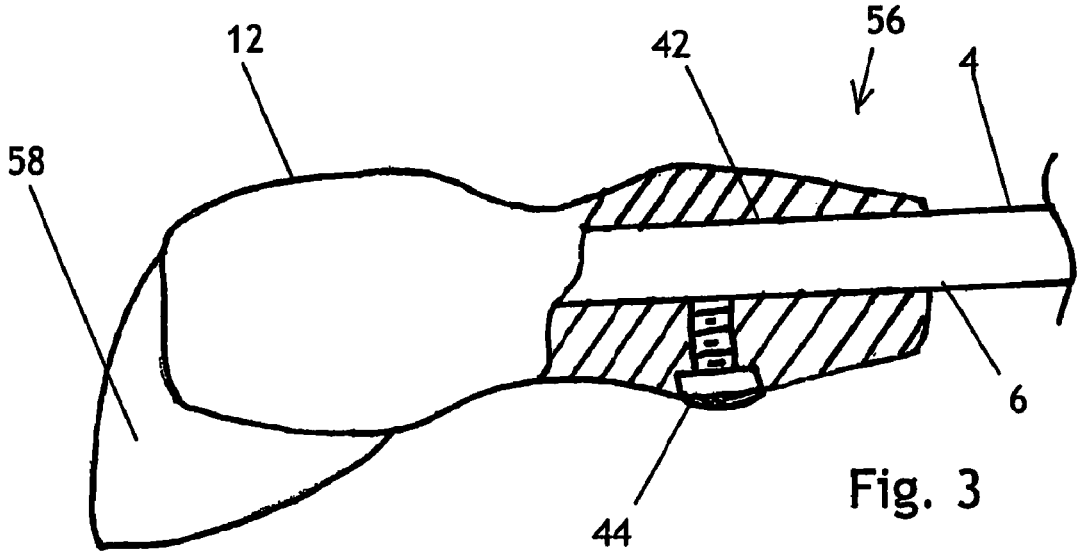
FIG. 3 is a detail cutaway of the handle.
Figure 8:
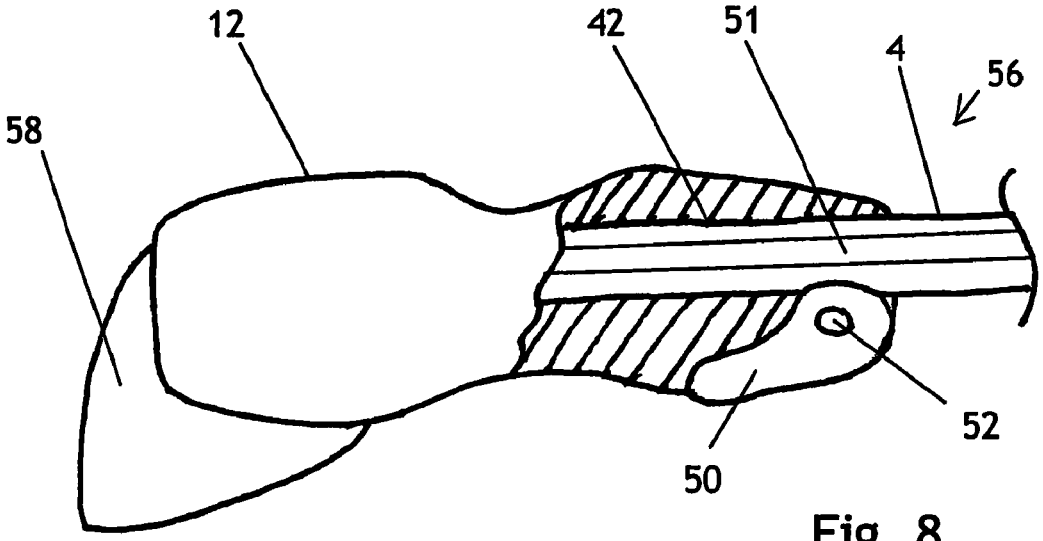
FIG. 8 is a detail cutaway of a cam clamp alternative.
Figure 9:
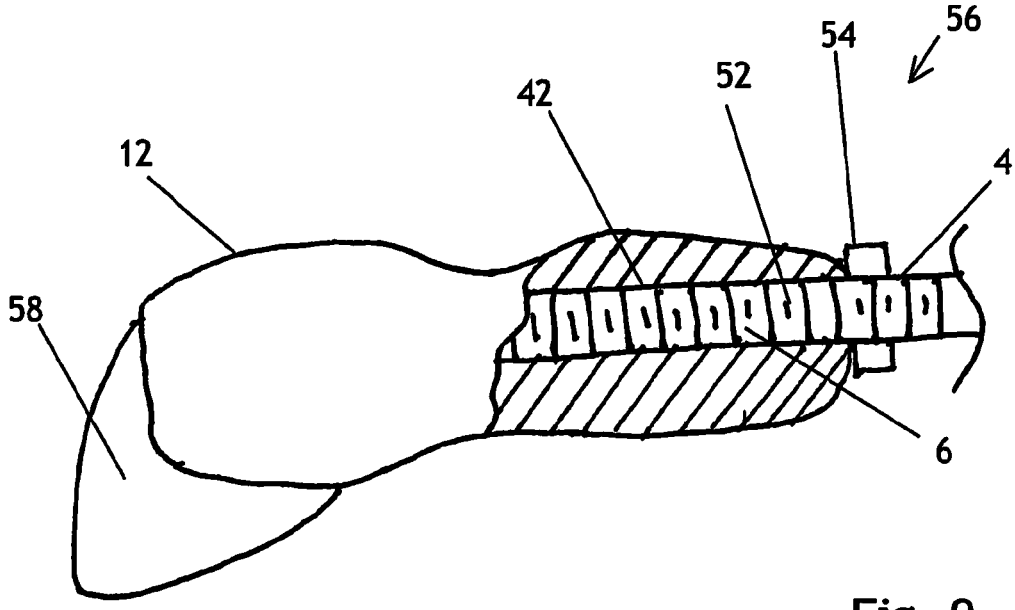
FIG. 9 is a detail cutaway of a threaded engagement alternative.

As shown by FIGS. 3, 8 and 9, the handle 12 may be adjustable with respect to the first end 6 of the arm 4. The player may select both the angular position of the handle 12 with respect to the arm, indicated by arrow 46 of FIG. 4, and also may select the axial position of the handle 12 with respect to the arm, indicated by arrow 48 of FIG. 2. By adjusting the axial position 48 of the handle 12 with respect to arm 4, the player can adjust the length of the hammer 2 along the head longitudinal axis 10 of the arm 4.

FIGS. 3, 8 and 9 illustrate adjusting mechanisms 56. In the handle adjusting mechanism 56 of the detail cutaway of FIG. 3, the first end 6 of arm 4 penetrates an arm-receiving opening 42 defined by handle 12. The arm 4 is held in position by set screw 44. To adjust the location of the handle 12 with respect to arm 4, and hence to adjust the angular location and the axial location of the handle with respect to the arm and head, the player loosens the set screw 44, moves the arm 4 to the desired location with respect to the handle 12 and re-tightens the set screw 44.

In the handle adjusting mechanism 56 of the detail cutaway of FIG. 8, the arm 4 penetrates an arm-receiving opening 42 in the handle 12. A cam clamp 50 rotates about axis 52, selectably clamping the handle 12 to the arm 4. To adjust the handle 12, the player releases the cam clamp 50, selects the position of the handle 12 with respect to the arm 4 and re-engages the cam clamp 50, locking the handle 12 in the selected location.

FIG. 8 also illustrates an arm 4 having multiple sides 51. In the instance illustrated by FIG. 8, the arm has eight sides. The opening 42 in the handle 12 also has eight corresponding sides, allowing the player to select among eight angular orientations 46 of the handle 12 with respect to the arm 4 and head 22.

In the handle adjusting mechanism of the detail cutaway of FIG. 9, first end 6 of arm 4 features male threads 52 and hole 42 in the handle 12 features mating female threads. The first end 6 of arm 4 and the hole 42 are in threaded engagement. Jam nut 54 is also in threaded engagement with the threads 52 of arm 4. The desired axial and angular locations of the handle 12 are selected by rotating the arm with respect to the handle 12. The arm 4 and handle 12 are held in position by tightening jam nut 54 against the handle 12.

Plectrum 58 may be attached to handle 12. Plectrum 58 is in the shape of a conventional flat pick and allows a player to pluck a guitar string with plectrum 58 while holding hammer 2 by handle 12.

Figure 10:
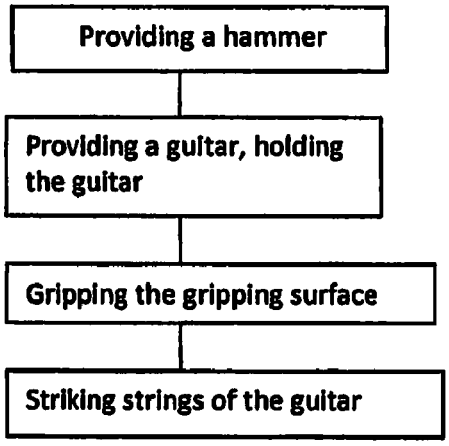
FIG. 10 is a flow chart of the method of the invention.
Figure 11:
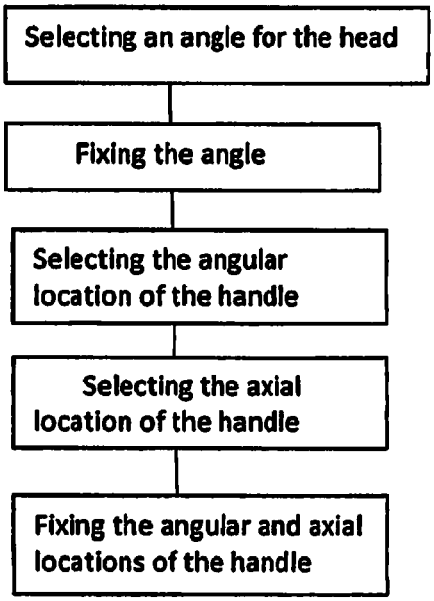
FIG. 11 is a flow chart of the method of the invention.

FIGS. 10 and 11 illustrate the method of the invention. FIG. 10 describes the steps of playing a guitar using the hammer 2 apparatus described above. FIG. 11 describes the method for adjusting the hammer 2 of the apparatus, as described above.

Figure 12:
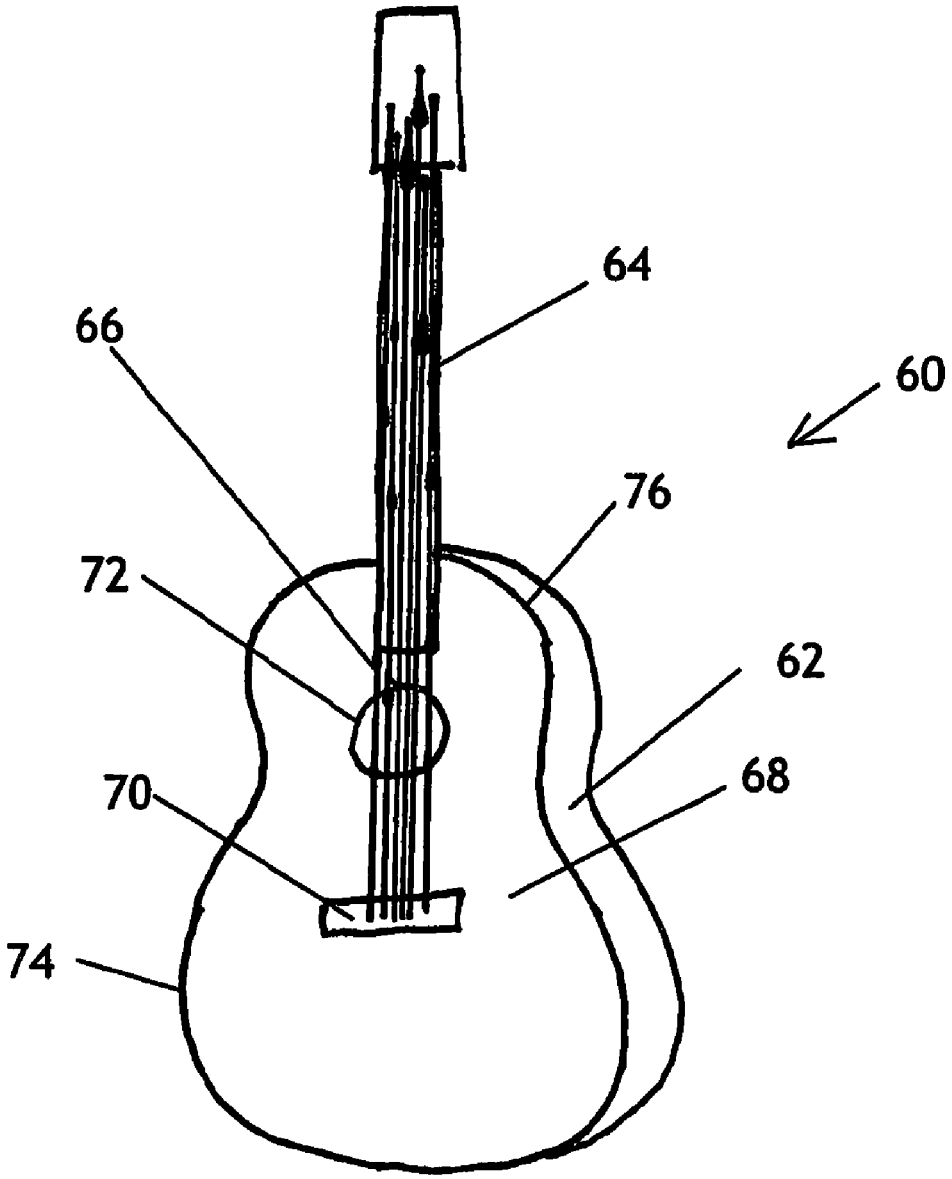
FIG. 12 is a perspective view of a conventional prior-art guitar.

FIG. 12 indicates the parts of a conventional acoustic guitar 60. The guitar 60 includes a body 62, a neck 64 and strings 66 stretched between the neck 64 and the body 62. The body 62 has a top 68 and a bridge 70. The body 62 defines a sound hole 72 and features a lower bout 74 and an upper bout 76. Sound hole 72 may be in locations other than shown on FIG. 12 and may be a shape other than circular. A conventional electric guitar 60 may dispense with sound hole 72 and may feature body 62 shapes other than that illustrated by FIG. 12.

LIST OF NUMBERED ELEMENTS

The following is a numbered list of elements as identified in the figures.

hammer 2
arm 4
first end 6
second end 8
arm longitudinal axis 10
handle 12
handle attachment 13
two opposing sides 14
pair of gripping surfaces 16
first line 18
second line 20
head 22
head attachment 23
striking surface 24
head longitudinal axis 26
angle 28
line 29
arrow 30 (adjustment of angle 28)
lockable pivot 32
clamp screw 34
peg-engaging openings 36
plurality of holes defining a plurality of selectable attachment locations 38
length 40 (of head longitudinal axis 26)
strings 66
curve 41
arm-receiving opening 42
set screw 44
angular location 46 (defining the angular position of the arm)
axial location 48 (defining the hammer length)
cam clamp 50
multiple sides 51
threads 52
an adjusting mechanism 56
plectrum 58
guitar 60
body 62
neck 64
strings 66
guitar top 68
bridge 70
sound hole 72
lower bout 74
upper bout 76

I claim:

1. A hammer for playing a guitar, the hammer comprising:

a. an arm, said arm having a first end and a second end, said arm being elongated, said arm defining an arm longitudinal axis;

b. a handle, said handle being attached to said first end of said arm, said handle having two opposing sides, said opposing sides defining a pair of gripping surfaces;

c. a head, said head being attached to said second end of said arm, said head defining a striking surface, said head having a head longitudinal axis, said head longitudinal axis being elongated, said striking surface extending along said head longitudinal axis of said head, said head longitudinal axis and said striking surface being generally transverse to said longitudinal axis of said arm.

2. The hammer of claim 1 wherein said head longitudinal axis and said arm longitudinal axis define an angle, said angle being fixed and oblique.

3. The hammer of claim 1 wherein said head longitudinal axis and said arm longitudinal axis define an angle, said angle being selectable by a player.

4. The hammer of claim 3, the hammer further comprising means to select said angle, said means being selected from a list consisting of a lockable pivot joining said arm and said head and a plurality of selectable attachment locations wherein said plurality of selectable attachment locations define a plurality of said angles.

5. The hammer of claim 4 wherein said angle is selectable to fall between plus or minus 72.5 degrees inclusive about a line normal to said arm longitudinal axis.

6. The hammer of claim 1 wherein said head longitudinal axis has a length, the guitar being a six-string guitar, said length being equal to or greater than a distance between a first and a fourth string of said six-string guitar along a plane generally normal to said first and said fourth strings.

7. The hammer of claim 6 wherein said striking surface defines a curve, said curve being flattened.

8. The hammer of claim 7 wherein said curve is an ellipse, said ellipse having an eccentricity, said eccentricity being greater than 0.7.

9. The hammer of claim 3 wherein said gripping surfaces are flat and parallel.

10. The hammer of claim 3 wherein said gripping surfaces are curved, said gripping surfaces being configured so that a first line falling on a one said gripping surface and also falling on a plane normal to said arm longitudinal axis is parallel to a second line falling on the other said gripping surface and also falling on said plane normal to said arm longitudinal axis.

11. The hammer of claim 1 wherein said hammer defines a hammer length from said head to said handle, said length being selectable by a player.

12. The hammer of claim 11 wherein said handle having an angular position with respect to said arm, said angular position being selectable by said player.

13. The hammer of claim 12 wherein said handle defines an arm-receiving opening and an adjusting mechanism, said arm engaging said arm-receiving opening, said adjusting mechanism being configured to select said hammer length and said angular position, said adjusting mechanism selectably fixing said selected length and said selected angular position.

14. The hammer of claim 13, the hammer further comprising: a plectrum, said plectrum depending from said handle.

15. A method of playing a guitar, the method comprising:

a. providing a hammer, said hammer having an arm, said arm having a first end and a second end, said arm being elongated, said arm defining an arm longitudinal axis, a handle, said handle having a handle attachment to said first end of said arm, said handle having two opposing sides, said opposing sides defining a pair of gripping surfaces, a head, said head having a head attachment to said second end of said arm, said head defining a striking surface, said head having a head longitudinal axis, said head longitudinal axis being equal to or greater than the distance between a first string and a fourth string of a six-string guitar, said striking surface extending along said head longitudinal axis, said striking surface being generally transverse to said arm longitudinal axis;

b. providing the guitar having a body, a neck attached to said body and strings attached to said body and said neck;

c. holding said guitar by a player so that said body is against a torso of said player;

d. gripping said gripping surfaces between a thumb and first finger of said player when said player is holding the guitar;

e. striking a plurality of said strings of the guitar with said striking surface of said hammer by said player.

16. The method of claim 15, the method further comprising:

a. selecting by said player of an angle defined by said head longitudinal axis and said arm longitudinal axis; and b. fixing said selected angle.

17. The method of claim 16, the method further comprising:

a. selecting by said player of an angular location of said handle with respect to said arm; and b. fixing said selected angular location.

18. The method of claim 17, the method further comprising:

a. selecting by said player of an axial location of said handle with respect to said arm; and b. fixing said axial location.

19. The method of claim 18 wherein said selecting by said player of said angular location and said axial location of said handle with respect to said arm comprises:

a. loosening a set screw;

b. selecting said angular location and said axial location; and c. tightening said set screw.

20. The method of claim 19 wherein said selecting by said player of an angle between said head longitudinal axis of said head and said longitudinal axis of said arm comprises:

a. loosening a clamp screw attaching said arm to said head;

b. selecting said angle;

c. tightening said clamp screw.

* * * * *